US005466337A

United States Patent [19]

Darlington et al.

[11] Patent Number: 5,466,337

[45] Date of Patent: Nov. 14, 1995

[54] REPULPABLE WET STRENGTH PAPER

[75] Inventors: William B. Darlington, Chillicothe, Ohio; William G. Lanier, Marietta, Ga.

[73] Assignee: The Mead Corporation, Dayton, Ohio

[21] Appl. No.: 406,175

[22] Filed: Mar. 17, 1995

Related U.S. Application Data

[62] Division of Ser. No. 192,144, Feb. 4, 1994, Pat. No. 5,427, 652.

[51] Int. Cl.[6] ..... D21H 21/20

[52] U.S. Cl. ..... 162/164.3; 162/164.6; 162/168.2; 162/168.3; 162/183; 162/189; 162/191

[58] Field of Search ..... 162/164.1, 164.3, 162/164.6, 168.2, 168.3, 158, 183, 189, 191

[56] References Cited

U.S. PATENT DOCUMENTS

| | | | |
|---|---|---|---|
| 2,961,367 | 11/1960 | Weisgerber | 162/158 |
| 3,219,518 | 11/1965 | Barber et al. | 162/175 |
| 3,236,721 | 2/1966 | Curtis | 162/175 |
| 3,320,066 | 5/1967 | Garth | 96/85 |
| 3,556,932 | 1/1971 | Coscia et al. | 162/166 |
| 3,556,933 | 1/1971 | Williams et al. | 162/167 |
| 3,607,622 | 9/1971 | Espy | 162/167 |
| 3,728,215 | 4/1973 | Espy | 162/167 |
| 4,035,229 | 7/1977 | Rave | 162/164.3 |
| 4,079,044 | 3/1978 | Rave | 260/72 R |
| 4,117,199 | 9/1978 | Gotoh et al. | 428/486 |
| 4,188,446 | 2/1980 | Friedman | 428/288 |
| 4,233,411 | 11/1980 | Ballweber et al. | 525/155 |
| 4,308,092 | 12/1981 | Latimer et al. | 162/111 |
| 4,420,368 | 12/1983 | Drach | 168/8 |
| 4,557,801 | 12/1985 | Avis | 162/157.6 |
| 4,566,943 | 1/1986 | Hansson et al. | 162/168.2 |
| 4,624,743 | 11/1986 | Gess | 162/164.1 |
| 4,722,964 | 2/1988 | Chan et al. | 524/608 |
| 4,788,280 | 11/1988 | Billmers et al. | 536/104 |
| 4,845,148 | 7/1989 | Moore et al. | 524/512 |
| 5,138,002 | 8/1992 | Bjorkquist | 526/264 |
| 5,147,908 | 9/1992 | Floyd et al. | 524/49 |
| 5,163,931 | 11/1992 | Aldrett | 604/374 |

OTHER PUBLICATIONS

Paper Chemistry, 1991, pp. 84–91.

Paprican Report Summary, Pulp and Paper Reports, Jul. 12, 1991.

Chemical Processing Aids in Papermaking: A Practical Guide, pp. 146–147.

Tappi Monograph Series No. 29, Wet Strength in Paper and Paperboard.

Parez 631 NC Wet Strength Resin.

"the Chemistry of Wet–Strength Broke Repulping", Progress in Paper Recycling, Aug. 1992, pp. 17–23.

*Primary Examiner*—Peter Chin

*Attorney, Agent, or Firm*—Thompson Hine & Flory

[57] ABSTRACT

A repulpable wet strength paperboard formed from an aqueous dispersion of cellulosic fibers treated with a temporary cationic wet strength agent and a permanent wet strength agent or a reactive internal size wherein said temporary wet strength agent and said permanent wet strength agent or size are used in combined amounts sufficient to impart wet strength to said paper yet render said paper readily repulpable.

8 Claims, No Drawings

REPULPABLE WET STRENGTH PAPER

This is a divisional of application Ser. No. 08/192,144, filed Feb. 4, 1994 now U.S. Pat. No. 5,427,652.

BACKGROUND OF THE INVENTION

The present invention relates to an improved resin system for imparting wet strength to paper which yields a sheet which is readily repulpable.

Paper which is manufactured with chemical additives to improve the physical properties when in contact with a water-containing medium is known as wet strength paper. The wet strength resins which provide these properties are classified as being either "permanent" or "temporary," based on the permanence of the wet strength they provide. A number of chemical treatments have been used to impart permanent wet strength to paper, but the most common, by far, is the use of aminoplast and polyamide-epichlorohydrin (PAE) resins.

As a result of the heightened awareness and increased demand for paper products containing recovered cellulose fiber, efforts have been undertaken to develop paper products which are more readily recyclable. Commercially available wet strength paperboard products are difficult to repulp because they utilize permanent wet strength resins. The addition of permanent wet strength resins interferes with and detracts from the repulpability of paper. Wet strength paper generally cannot be defibered and repulped in neutral water without extraordinary means. Permanent resins are resistant to hydrolysis and retain their properties during repulping. The mechanism by which they provide wet strength is through bonding to or encapsulation of the cellulose fibers to provide a water-resistant, hydrolytically-stable, polymer-reinforced cellulose fiber network. Paperboard treated with aminoplast resin requires high temperatures and/or low pH during repulping to be recycled. On the other hand, high pH and elevated temperatures are required to repulp PAE-treated papers. Polyamide and polyamine-epichlorohydrin (PAE) resins form ether linkages with the hydroxyl groups in the cellulose through an epoxide linkage. These bonds are difficult to break.

Temporary wet strength resins are generally distinguished from permanent wet strength resins in that wet strength achieved using temporary wet strength resins is essentially lost after 10 to 30 minutes soaking in water at neutral pH and room temperature. Temporary wet strength resins are well known and have been used in the art to make disposable products, such as toweling and tissues. Temporary wet strength agents are generally hydrolytically unstable or shear sensitive. These properties enable the resin to break down readily when the product is commercially repulped. While temporary wet strength agents are more compatible with repulping than permanent wet strength agents, they do not develop satisfactory wet strength for most paperboard applications.

SUMMARY OF THE INVENTION

In accordance with the present invention a paperboard is provided which provides adequate wet strength, e.g., it retains at least 50% of its dry tear strength when saturated with water, and yet it is readily repulpable. The paperboard is made by treating paper fibers with a cationic temporary wet strength agent in combination with either a permanent wet strength agent or an internal size. In accordance with a preferred embodiment of the invention, a cationic promoter is added to the paper fiber before adding the wet strength agents to neutralize anionic agents present in or added to the pulp.

Wet strength board must retain its physical properties when in contact with an aqueous medium. It is commonly used for beverage carriers that may be partially or completely wetted by the customer. It should retain its strength in relatively static water at room temperature (20°– 30° C.) and a neutral pH. To be readily repulpable, however, it should disintegrate easily in a repulper at a temperature of 38°–60° C. and a pH of 6–8. Thus, it will be appreciated that the service conditions for paperboard are not greatly different from those encountered in repulping. The critical differences are the higher temperature and the energy and shear that result from the agitation of repulping.

In accordance with the invention, to take advantage of the higher temperature, a resin that hydrolyses more quickly than the PAE resin commonly used in paperboard is incorporated into the board. Such resins are so-called temporary wet strength resins, such as a glyoxalated polyacrylamide like Parez 631NC. This resin will weaken quickly at the temperature in the pulper.

Temporary wet strength agents alone do not provide adequate wet strength and must be combined with another material to provide useful wet strength for most paperboard applications. In accordance with one embodiment of the invention, the temporary wet strength agent is combined with a permanent wet strength agent such as PAE. While not desiring to be bound, it is believed that the two resins, which are both cellulose reactive, achieve part of their wet strength performance by bonding to the cellulose fibers. The two resins may also react with each other and form an interpolymer network that provides wet strength by encapsulating the cellulose fibers. This long-chain interpolymer network is shear sensitive so that under the high shear conditions in the repulper, the polymer chains are broken, the wet strength is lost and the board repulps easily.

In another embodiment, the temporary wet strength agent is combined with a reactive size such as an alkyl ketene dimer (AKD). An AKD size has been found to enhance the wet strength of board containing a temporary agent like Parez and still produce a repulpable board. The mechanism for the ease of repulping this product is believed to arise from the shear sensitivity of AKD. Under high shear, such as that in a repulper, the polymer chain length is broken and the interpolymer network of the AKD and temporary wet strength agent holding the cellulose fibers together is believed to be broken down. Without this "glue" the board disintegrates under the action within the repulper.

DETAILED DESCRIPTION OF THE INVENTION

The term "paperboard" is used herein as it is used in the *Pulp and Paper Dictionary,* 1986, to mean any thick, heavyweight, rigid, single or multi-ply paper used in wrappings, packaging, boxes, containers, advertising, merchandising displays, building construction, etc. and includes any cellulosic fiber-containing mat or web having a thickness of about 12 mil (0.012 inch) or greater which is prepared from any aqueous suspension of cellulose fiber and which may contain other fibrous matter such as organic, inorganic, or synthetic fibers. Examples include paperboard, linerboard medium and container board or boxboard, any of which may be coated or uncoated.

It has been found the wet strength system of the invention is effective on cellulosic fibers from any fiber source including, but not limited to, any bleached or unbleached hardwood or softwood chemical, mechanical or chemimechanical pulp. The treatment has been found to be particularly useful with unbleached pulps and, still more particularly with sulfite, Kraft and semi-chemical pulps and other pulps used in the manufacture of paperboard. The wet strength system is also useful in making paperboard which contains recycled fiber from sources such as old corrugated container board or OCC.

The cationic temporary wet strength agent used in the invention can be selected from among those cationic temporary wet strength agents known in the art such as dialdehyde starch, polyethylene imine, mannogalactan gum, glyoxal, and dialdehyde mannogalactan. A particularly useful class of temporary wet strength agent is cationic glyoxylated vinylamide wet strength resins.

Glyoxylated vinylamide wet strength resins useful herein are described in U.S. Pat. No. 3,556,932 to Coscia. These resins are typically reaction products of glyoxal and preformed water soluble vinylamide polymers. Suitable polyvinylamides include those produced by copolymerizing a vinylamide and a cationic monomer such as 2-vinylpyridine, 2-vinyl-N-methylpyridinium chloride, diallyldimethyl ammonium chloride, etc. Reaction products of acrylamide diallyldimethyl ammonium chloride in a molar ratio of 99:1 to 75:25 glyoxal, and polymers of methacrylamide and 2-methyl- 5-vinylpyridine in a molar ratio of 99:1 to 50:50, and reaction products of glyoxal and polymers of vinyl acetate, acrylamide and diallyldimethyl ammonium chloride in a molar ratio of 8:40:2 are more specific examples provided by Coscia. These vinylamide polymers may have a molecular weight up to 1,000,000, but polymers having molecular weights less than 25,000 are preferred. The vinylamide polymers are reacted with sufficient glyoxal to provide a water soluble thermoset resin. In most cases the molar ratio of glyoxal derived substituents to amide substitutes in the resin is at least 0.06:1 and most typically 0.1:1 to 0.2:1. A commercially available resin useful herein is Parez 631NC sold by Cytec Industries.

The cationic temporary wet strength agent is generally added to the paper in an amount up to about 8 pounds per ton or 0.4 wt %. Generally, the cationic temporary wet strength agent is provided by the manufacturer as an aqueous solution and is added to the pulp in an amount of about 0.05 to 0.4 wt % and more typically in an amount of about 0.1 to 0.2 wt %. Unless otherwise indicated all weights and weight percentages are indicated herein on a dry basis. Depending on the nature of the resin, the pH of the pulp is adjusted prior to adding the resin. The manufacturer of the resin will usually recommend a pH range for use with the resin. The Parez 631NC resin can be used at a pH of about 4 to 8.

The permanent wet strength agents used in practicing the invention can be selected from among those aminoplast resins (e.g., urea-formaldehyde and melamine-formaldehyde) resins and those polyamine-epichlorohydrin, polyamide epichlorohydrin or polyamide-amine epichlorohydrin resins (collectively "PAE resins") conventionally used in the papermaking art. Representative examples of these resins are described throughout the literature. See, for example, *Wet Strength in Paper and Paperboard*, TAPPI Monograph Series No. 29, Tappi Press (1952) John P. Weidner, Editor, Chapters 1, 2 and 3 and U.S. Pat. Nos. 2,345,543 (1944) 2,926,116 (1965), and 2,926,154 (1960). Typical examples of some commercially available resins include the PAE resins sold by Hercules under the name Kymene, e.g., Kymene 557H and by Georgia Pacific under the name Amres, e.g., Amres 8855.

The permanent wet strength agent is added to the paper fiber in an amount up to about 8 pounds per ton or 0.4 wt % and typically about 0.01 to 0.2 wt % and still more typically about 1 to 2 pounds per ton or 0.05 to 0.1 wt %. The exact amount will depend on the nature of the fibers and the amount of wet strength required in the product. As in the case of the temporary wet strength agent, these resins are generally recommended for use within a predetermined pH range which will vary depending upon the nature of the resin. For example, the Amres resins are typically used at a pH of about 4.5 to 9.

It has been found that repulpable papers having satisfactory wet strength can also be prepared using a reactive internal size instead of or in addition to the aforesaid permanent wet strength agent. By "reactive" is meant that the size chemically bonds to the cellulose fiber. Examples of reactive internal sizes useful in the invention are alkyl ketene dimers (AKD) as described in U.S. Pat. Nos. 4,627,477; 2,785,067; 2,762,270, 3,483,077 and alkenyl succinic anhydride (ASA) as described in U.S. Pat. No. 3,821,069. These sizes are commercially available and their usage is well established in the papermaking art. A representative example of a commercially available AKD size is Hercon 70 from Hercules Chemical Co. A representative example of an ASA size is Accosize AT manufactured by Cytec Industries. Other materials which may have application as internal sizes are fatty acid chlorides, fatty acid enol esters, fatty acid alkyl isocyanates and rosin acid anhydride.

The reactive internal size is used in an amount of about 0.01 to 0.3% and typically in an amount of about 0.05 to 0.1%.

The presence of anionic additive or agents in the pulp has a deleterious effect on the efficiency of the temporary wet strength agent, which is cationic. This adverse impact can be eliminated by treating the stock with cationic resins known in the industry as cationic promoters. These cationic promoters enable more of the wet strength resins to bond to the cellulose because less anionic material is present to consume the resin. These resins are generally selected for their low cost. Some examples of cationic resins useful for this application are polyethyleneimine with a cationic charge of about 0.75 to 3.5 milliequivalents/gram, quaternized polyamines, such as polydiallyldimethylammonium chloride, or cationic starch. Particularly useful cationic resins are polyquaternary amines and are available from Cytec Industries under the trade names CYPRO 514, 515, 516.

Cationic promoters are added to the stock well in advance of the wet strength resins to ensure adequate mixing and adequate contact with the fibers. When used, the cationic resins are generally used in an amount of about 1 to 10 pounds per ton or 0.05 to 0.5%. The cationic promoter can be used at 0 to 0.5 wt %, typically the resins are used in an amount of about 0.02 to 0.3 wt % and preferably 0.1 to 0.2 wt %. The manufacturer of the promoter will typically recommend a pH for its use. The Cypro resins are effective over a pH of about 4 to 9.

Wet strength papers prepared in accordance with the invention may also incorporate other additives conventionally used in the paper industry such as sizes and fillers. In particular, it is desirable to incorporate sizes such as rosin and alum into the stock. Rosin is generally added to the stock as a neutral or acid size in an amount of about 4 to 8 lb/ton of fiber. Alum is used in an amount of about 20 to 40 lb/ton of fiber.

To prepare the wet strength paper, a paper stock, typically having a consistency of about 0.3 to 1.0% is prepared. The point of addition of the wet strength system can vary depending on the design of the paper machine and the nature of the paper product as long as the wet strength chemicals have an adequate opportunity to react with the fiber before the sheet is formed. The wet strength agents can be added at any point before the head box, such as in the stock chest, refiners, or fan pump. In one preferred treatment, the alum and rosin are added to the stock and mixed followed by the addition of the cationic promoter. After the cationic promoter has had an adequate opportunity to react with the fiber (e.g., about 20 sec. to 5 minutes at 3–8 pH), a solution of the temporary wet strength agent is added with the permanent wet strength agent and/or the reactive size.

The amount and ratio of the wet strength agents and size are adjusted to provide a wet strength comparable to that achieved with PAE resins yet provide a repulpable product. The amounts can be varied to provide the necessary balance between wet strength and repulpability. In terms of comparability to PAE, in making paperboard a wet to dry tear ratio of at least 70% is desired. To be considered easily recyclable, a product should yield more than 30% and preferably at least 60% and most preferably at least 75% usable fiber after repulping 15 to 60 minutes at 100° F., 4% consistency at a pH 9 or less. The amount of reusable fiber is the amount of fiber collected through a "six cut" vibrating screen with 0.006 inch slots. The fiber is dried and weighed after equilibrating at 50% RH at 23° C.

The invention is illustrated in more detail by the following non-limiting examples:

EXAMPLE 1

A 70 lb/1000 $ft^2$ board sheet was made from virgin, unbleached, kraft pine pulp with a Canadian standard freeness of 650 ml. The sheet was made on an M-K sheet former manufactured by M-K Systems. This device makes a sheet that is 12-in.×12-in.

To make the sheet, pulp containing 31.8 grams of fiber on a dry basis was diluted to 0.6 wt. % with distilled water, poured into the sheet former, and the temperature adjusted to 70° to 80° F. Then 48 gms. of a 1% solution of papermakers alum was mixed with the pulp. Next 0.128 gms. of a liquid rosin size (50% solids), Plasmene N-750-P made by Georgia-Pacific, was stirred into the pulp. The pH of the pulp slurry was then adjusted to 4.8 with 5% sulfuric acid. Then 0.05% (0.032 gms. of a 50% aqueous solution) of a polyquaternary amine cationic promoter, Cypro 515 made by Cytec Industries was mixed well with the pulp. Next 0.05% (0.13 gms. of a 12.5% aqueous solution) of a polyamide-polyamine-epichlorohydrin resin, Amres 8855 made by Georgia-Pacific, was mixed into the pulp. Lastly, 0.05% (0.27 gms. of a 6% aqueous solution) of a glyoxalated polyacrylamide resin solution, Parez 631NC made by Cytec Industries, was mixed into the pulp.

The sheet was then deposited on the wire of the former. After couching the sheet from the wire, it was pressed between blotter paper at 90 psi. The sheet was dried, under constraint, for 15 min. at 105° C. and then placed in a room at 50% relative humidity and 23° C. for 24 hrs. before testing.

The dry tensile index of the board was determined by TAPPI method T 456-om-88. The wet tensile index was determined by the same method after the board has been soaked in distilled water for one hour at 23° C. The ratio of these two values was 0.77.

The repulpability of the board was determined by adding 110 grams of it to 2895 grams of deionized water at 120° F. with a pH of 6–7 and repulping in a Maelstrom laboratory pulper manufactured by Adirondac Machine Co. The board was allowed to soak for 15 min. before turning on the pulper motor. After 15 minutes of agitation, a sample of pulp containing 11 grams of dry fiber was taken from the pulper and screened through a vibrating plate, Somerville screen with 0.006 in. slots manufactured by Messmer-Buchel. The fiber retained on the screen and that passing through the screen were collected separately and dried and weighed after equillibrating at 50% relative humidity and 23° C. The percent of the fiber fed to the screen that passed through it was the repulping yield. For this board the yield was 82%.

EXAMPLE 2

Board was made as described in Example 1 with alum and rosin size, but without the use of any cationic promoter (Cypro). A quantity of 0.05% (0.13 gms. of a 12.5% aqueous solution) of a polyamide-polyamine-epichlorohydrin resin, Amres 8855 made by Georgia-Pacific, was added along with 0.15% (0.80 gms. of a 6% aqueous solution) of a glyoxalated polyacrylamide resin solution, Parez 631NC made by Cytec Industries.

The ratio of the wet to dry tear of this board was 0.71. The fiber yield after 15 min. of repulping was 66%.

EXAMPLE 3

A board was prepared by the method of Example 1 which contained, in addition to the rosin and alum, 0.2% (0.52 gms. of a 12.5% aqueous solution) of Amres 8855, but no glyoxalated polyacrylamide resin or cationic promoter.

The wet to dry tear ratio was 0.82 and the fiber yield on repulping was 32%.

EXAMPLE 4

A board was prepared by the method of Example 1 which contained, in addition to the rosin and alum, 0.10% (0.26 gms. of a 12.5% aqueous solution) of Amres 8855, 0.10% (0.53 gms. of a 6% aqueous solution) of Parez 631NC. Before depositing the sheet 0.1% (0.26 gms. of a 12.5% aqueous solution) of alkyl ketene dimer, Hercon 70 manufactured by Hercules, Inc. was mixed with the pulp.

The wet to dry tear ratio was 0.77 and the fiber yield on repulping was 50%.

EXAMPLE 5

A board was prepared by the method of Example 1 which contained, in addition to the rosin and alum, 0.25% (1.36 gms. of a 6% aqueous solution) of Parez 631NC. Before depositing the sheet 0.1% (0.26 gms. of a 12.5% aqueous solution) of alkyl ketene dimer, Hercon 70 manufactured by Hercules, Inc., was mixed with the pulp.

The wet to dry tear ratio was 0.72 and the fiber yield on repulping was 87%.

EXAMPLE 6

A board was prepared by the method of Example 1 which contained, in addition to the rosin and alum, 0.05% (0.032 gms. of a 50% aqueous solution) of a polyquaternary amine promoter, Cypro 515 made by Cytec Industries that was mixed well with the pulp. Then 0.20% (1.1 gms. of a 6% aqueous solution) of Parez 631NC was stirred with the pulp.

Before depositing the sheet 0.1% (0.26 gms. of a 12.5% aqueous solution) of alkyl ketene dimer, Hercon 70 manufactured by Hercules, Inc., was mixed with the pulp.

The wet to dry tear ratio of this board was 1.07 and the fiber yield on repulping was 37%. The wet to dry tear ratio of this product is much higher than necessary. By reducing the amount of the resins and AKD, a board having lower but adequate wet to dry tear and higher repulped fiber yield should be available.

COMPARATIVE EXAMPLE 7

A board was prepared by the method of Example 1 which contained, rosin and alum, but no other resins.

The wet to dry tear ratio was 0.41 and the fiber yield on repulping was 99%.

EXAMPLE 8

A board was prepared by the method of Example 1 which contained, in addition to the rosin and alum, 0.05% (0.032 gms. of a 50% aqueous solution) of the cationic promoter Cypro 515), 0.05% (0.13 gms. of a 12.5% aqueous solution) of Amres 8855, and 0.1% (0.53 gms. of a 6% aqueous solution) of Parez 631NC, and 0.1% (0.26 grams of a 12.5% aqueous solution) of Hercon 70.

The wet to dry tear ratio was 1.16 and the fiber yield on repulping was 20%. The wet to dry tear ratio of this product is much higher than necessary. By reducing the amount of the resins and AKD, a board having lower but adequate wet to dry tear and higher repulped fiber yield should be available.

Having described the invention in detail and by reference to preferred embodiments thereof, it will be apparent that modifications and variations are possible without departing from the scope of the invention defined in the appended claims.

What is claimed is:

1. A method for recycling paperboard which comprises providing a recyclable paperboard product formed from an aqueous dispersion of cellulosic fibers treated with a temporary cationic wet strength agent and a permanent wet strength agent; said temporary cationic wet strength agent being a glyoxylated vinylamide wet strength resin and said permanent wet strength agent being selected from the group consisting of polyamine epichlorohydrin, polyamide epichlorohydrin and polyamine-amide epichlorohydrin resins, wherein the amount of the temporary cationic wet strength agent is at least 0.05 wt % and the amount of the permanent wet strength agent is at least about 0.01 wt %; repulping said paperboard; and recovering the cellulosic fibers.

2. The method of claim 1 wherein said cellulosic fibers are additionally treated with a cationic resin which has been added to said dispersion prior to said wet strength agents to sequester anionic agents in said dispersion.

3. The method of claim 1 wherein said temporary wet strength agent is a glyoxylated copolymer of acrylamide and diallyldimethyl ammonium chloride.

4. The method of claim 1 wherein said cellulosic fibers are additionally treated with a cationic resin which has been added to said dispersion prior to said wet strength agents to sequester anionic agents in the said dispersion.

5. The method of claim 1 wherein said temporary wet strength agent is a glyoxylated copolymer of acrylamide and diallyldimethyl ammonium chloride.

6. The method of claim 1 wherein said paperboard is at least 12 mil thick.

7. The method of claim 1 wherein said permanent wet strength is present in an amount of about 0.01 to 0.4 wt %.

8. The method of claim 7 wherein said temporary wet strength agent is present in an amount of about 0.05 to 0.4%.

* * * * *